US006297728B1

(12) United States Patent
Rippbauer

(10) Patent No.: US 6,297,728 B1
(45) Date of Patent: Oct. 2, 2001

(54) METHOD AND DEVICE FOR PREVENTING PERSONS FROM FALLING ASLEEP

(76) Inventor: Gert Rippbauer, Herrenrebenweg 4, CH-5507 Mellingen (CH)

( * ) Notice: Subject to any disclaimer, the term of this patent is extended or adjusted under 35 U.S.C. 154(b) by 0 days.

(21) Appl. No.: 09/367,808

(22) PCT Filed: Dec. 15, 1998

(86) PCT No.: PCT/CH98/00535

§ 371 Date: Aug. 19, 1999

§ 102(e) Date: Aug. 19, 1999

(87) PCT Pub. No.: WO99/35626

PCT Pub. Date: Jul. 15, 1999

(30) Foreign Application Priority Data

Jan. 9, 1998 (CH) ..... 26/98
Dec. 10, 1998 (CH) ..... 2450/98

(51) Int. Cl.[7] ..... G08B 1/00

(52) U.S. Cl. ..... 340/309.15; 340/573.1; 340/575; 128/848

(58) Field of Search ..... 340/575, 576, 340/573.1; 128/848

(56) References Cited

U.S. PATENT DOCUMENTS 4,470,263 * 9/1984 Lehovec et al. ..... 62/3
4,987,896 * 1/1991 Nakamatsu ..... 128/399

* cited by examiner

*Primary Examiner*—Daryl Pope
(74) *Attorney, Agent, or Firm*—Tarolli, Sundheim, Covell, Tummino & Szabo L.L.P.

(57) ABSTRACT

In order to prevent persons driving a vehicle from falling asleep, it is proposed to cool a specific location on the head of the related person. Preferably, the cooling is accomplished by means of a cooled, moving gas or by putting on a plate member (10) that is in thermal contact with a cooling assembly (6). Preferably, the cooling assembly (6) is in the form of a Peltier cell. By locally cooling the head, a sleepy person can be reliably kept awake over an extended period of time.

18 Claims, 3 Drawing Sheets

METHOD AND DEVICE FOR PREVENTING PERSONS FROM FALLING ASLEEP

The present invention refers to a method for preventing persons from falling asleep according to the preamble of claim 1 as well as to an apparatus for performing the method according to the preamble of claim 8 and claim 14, respectively.

Methods and apparatuses for preventing persons from falling asleep are well known in the art in various embodiments. By means of apparatuses of this kind, it should be ensured, particularly with persons driving a car or guiding a locomotive or an airplane, that a beginning sleepiness can be postponed for a sufficient time that it can be driven to the next rest area or the next train stop, respectively, or, in the case of airplanes, that the pilot can be replaced by another qualified person and that the plane can be safely landed, respectively.

The U.S. Pat. No. 4,203,098 discloses an apparatus of this kind for preventing a person driving a car from falling asleep that comprises a vibrator to be fastened to the seat back of the driver's seat. That vibrator is electrically connected to a pulsator to be fastened to the dashboard and which electrically triggers the vibrator. Test conducted with such an apparatus have shown that the danger exists that the driver becomes accustomed to the vibrations in the course of time; thus, the apparatus looses its efficiency in the long term.

Thus, it is an object of the invention to propose a method for preventing persons from falling asleep that operates efficiently and which avoids the danger that a person becomes accustomed to it in the long term.

This object is met by the method described in the characterizing portion of claim 1.

Surprisingly, it has shown that a person tightening with sleepiness can be reliably kept awake if a specific location on its head, particularly on its forehead, is cooled, presumed that the sleepiness is caused neither by the influence of alcohol or drugs nor by medication, health problems or serious lack of sleep.

Moreover, further tests have shown that persons treated with the proposed method do not shown any sign of getting used to that cooling treatment, even in the long term.

Preferred embodiments of the method according to the invention are described in the dependent claims 2 to 7.

It is a further object of the invention to provide an apparatus by means of which the proposed method can be efficiently put into practice.

This object is met by the characteristics defined in the characterizing portion of claim 8 and in the characterizing portion of claim 14, respectively.

Preferred embodiments of the apparatus according to the invention are described in the dependent claims 9 to 19.

In the following, the invention will be further explained, with reference to the accompanying drawings, in which.

Figure 1:
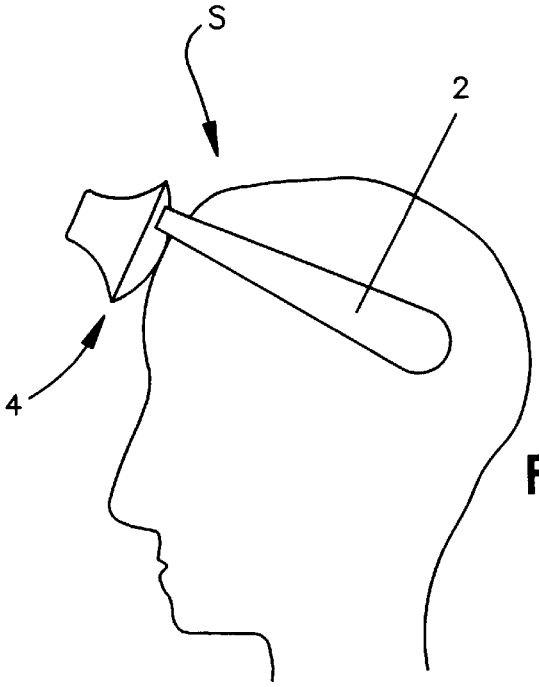
FIG. 1 shows a side elevational view of a first embodiment of the apparatus.
Figure 2:
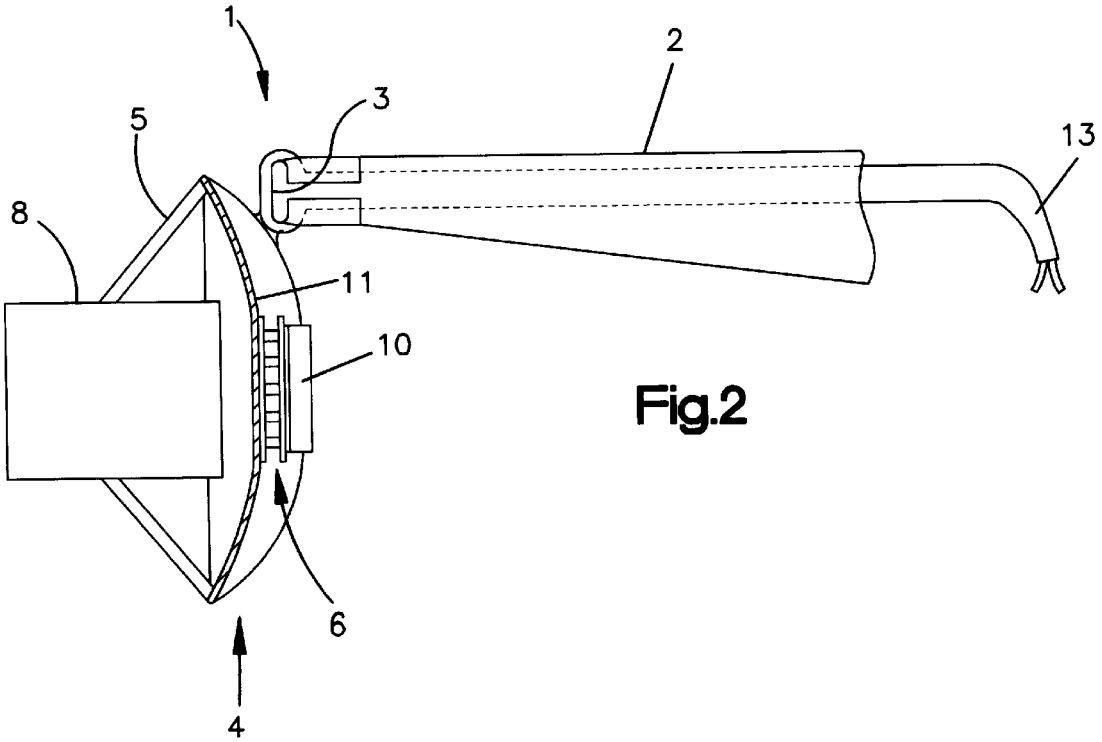
FIG. 2 shows a longitudinal sectional view of the apparatus according to FIG. 1.

The FIGS. 1 and 2 show a first embodiment of an apparatus that is particularly suitable for retrofitting a vehicle. The apparatus comprises a frame 1 having two shackle members 2 that can be put onto the head similar to goggles, whereby the frame 1 rests not on the nose, but on the forehead. The front face of the frame 1 is provided with a rail 3 to which a cooling assembly 4 is connected so as to be slidable along the rail 3. As the real cooling element, a Peltier cell 6 is provided. Since the general operation of a cooling device provided with a Peltier cell is known in the art, the following explanations are restricted to the facts that are essential for the present invention.

The cooling assembly 4 is provided with a housing 5, and in the back side thereof, a fan 8 is received which is directed towards the warm side of the Peltier cell 6. The front side of the cooling assembly 4 is provided with a circular metallic plate member 10 that is in thermal contact with the cold side of the Peltier cell 6. Preferably, the warm side of the Peltier cell 6 is provided with a heat sink 11 that is cooled by the fan 8. The supply of electric energy is accomplished by means of an electric conductor 13 that is inserted into one of the shackle members 2. The electrical conductor 13 can be provided with an electric plug by means of which it can be plugged-in directly into the cigarette lighter socket of a vehicle.

The metallic plate member 10 provided at the front side of the housing 5 rests on the forehead S of the user of the apparatus once the frame 1 has been put onto the head. Thus, a direct contact between metallic plate member 10 and the skin of the user and, thereby, a direct heat transfer is established. Instead of a metallic plate member 10, another element could be used that has good thermal conductive properties. The dimensions of the metallic plate member 10 preferably amounts to between 1 $cm^2$ and 3 $cm^2$. However, tests have shown that the area of the metallic plate member 10 can amount to between 0.25 $cm^2$ and 5 $cm^2$ in order to achieve the desired effect of keeping a person awake is ensured, whereby the minimal area is limited rather by practical than by scientific reasons.

By swiveling the frame 1 and, if appropriate, by displacing the cooling assembly 4 along the rail 3, the cooling assembly 4 can be placed practically in any arbitrary location of the forehead S. Displacing the cooling assembly 4 is particularly wise when the desired effect begins to wear off.

Such an apparatus can be stored, for instance, in a mount provided in the central console of a vehicle. An activation of the cooling assembly can be accomplished automatically by providing the mount with a contact switch means that switches the cooling assembly on upon picking-up the apparatus. Another possibility is to provide a manually operated switch.

Figure 3:
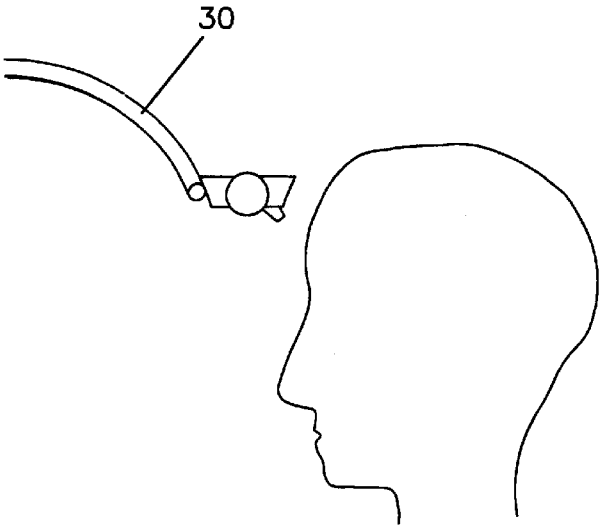
FIG. 3 shows a side elevational view of a second embodiment of the apparatus.
Figure 4:
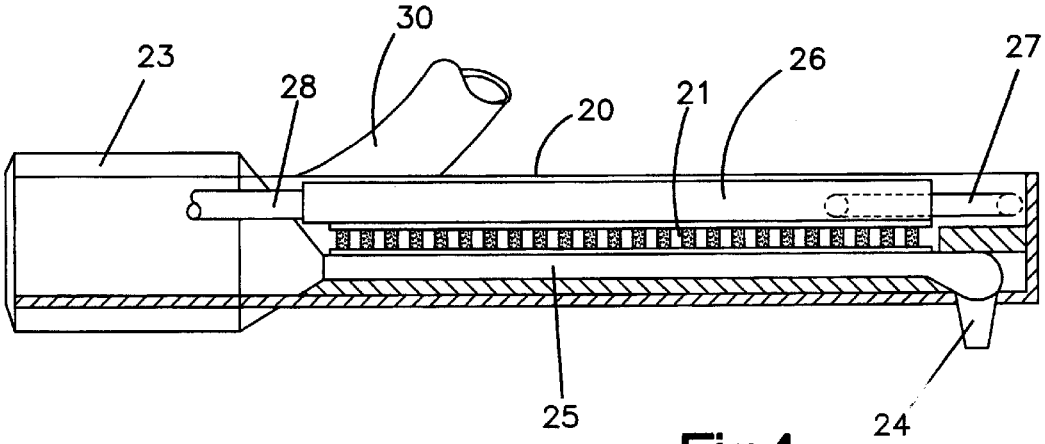
FIG. 4 shows a longitudinal sectional view of the apparatus according to FIG. 3.
Figure 5:
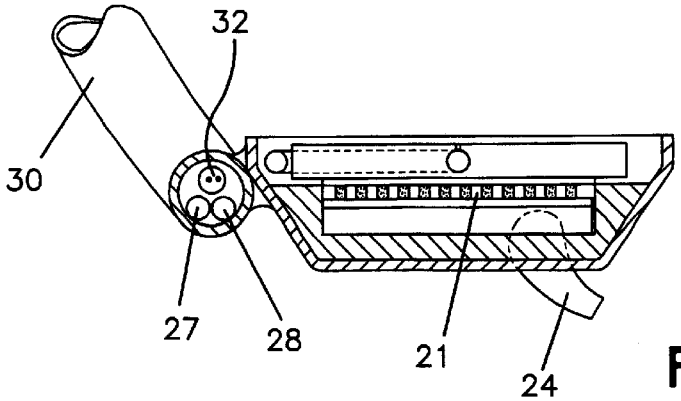
FIG. 5 shows a cross sectional view of the apparatus according to FIG. 3.

With the help of FIGS. 3 to 5, a second embodiment of the apparatus will now be further explained. Thereby, FIG. 3 shows a side elevational view of the apparatus, while FIG. 4 shows a longitudinal sectional view and FIG. 5 a cross sectional view of the apparatus. In contrast to the embodiment discussed herein before, the cooling is not accomplished by means of a metallic plate member to be placed on the forehead, but the cooling is effected by means of a focused jet of air directed to the forehead of the relating person.

The apparatus comprises a housing 20 in which is received a cooling assembly in the form of a Peltier cell 21. Moreover, the apparatus comprises a fan 23, a nozzle 24, a cooling channel 25 as well as a heat exhaust channel 26 that is connected to a heat exchanger, not visible in this illustration, be means of a feeder pipe 27 and an outlet pipe 28. In place of a Peltier cell 21, a conventional cooling aggregate, for example a refrigerator, could be provided as a cooling assembly; in that case, the feeder pipe 27 and the outlet pipe 28 would serve for transporting the corresponding cooling medium. Alternatively, as a cooling assembly, a container could be used that is periodically topped up with a cooled medium, e.g. frozen salt water.

The apparatus is mounted on a flexible tube member 30, the interior thereof receiving the two pipe 27, 28 connected to the heat exchanger. The electrical conductors 32 required for the operation of the fan 23 and the Peltier cell 21 are received in that flexible tube member 30 as well.

The operation of this embodiment of the apparatus can be explained as follows:

The fan 23 sucks ambient air that is lead via the cooling channel 25 along the cold side of the Peltier cell 21 and thereby cooled down. The cooled air escapes from the nozzle 24, whereby the latter one is designed such that the escaping jet of air is sharply focused and hits an area on the forehead of the user amounting to between 1 $cm^2$ and 5 $cm^2$.

In order to cool the warm side of the Peltier cell 21, a fluid, preferably water, is provided that circulates through the pipes 27, 28 and through the heat exchanger. The heat exchanger can be placed in a suitable location, in a passenger car for example in the room below the driver seat.

Due to the fact that the apparatus is mounted on a flexible tube member 30, the position of the afore mentioned apparatus and, thereby, of the nozzle can be manually adjusted. In this way, both the angle under which the jet of cool air hits the forehead of the user as well as the absolute position in which the jet of air hits the forehead of the user can be adjusted. It is understood that, alternatively or additionally, the nozzle can be designed adjustable.

Such an apparatus could be directly integrated into the roof structure of a vehicle. Thereby, a swiveling mechanism could be provided by means of which the apparatus could be swiveled between a rest position and an operating position. In the rest position, the apparatus could preferably be received in a recess provided in the roof of the vehicle.

A variant of the embodiment according to FIGS. 3 to 5 could be seen in a design in which air is used for heat removal instead of a fluid, whereby the air is lead directly along the Peltier cell, with the result that it would be not necessary to provide the feeder pipe 27 and the outlet pipe 28.

The start-up of the apparatus can either be initiated by the driver or automatically. For a fully automated start-up, a monitoring means had to be provided that continuously monitors the driver and starts-up the apparatus as soon a the first signs of sleepiness are observed. Since such monitoring devices are well known in the art, it is not necessary to further describe them here.

Moreover, it could be considered to provide for an automatic variation of the position of the jet of air and/or of its hitting angle. Further, there could be provided a pulsation of the jet of air, whereby the pulsation frequency should be in the region of some ten seconds up to several minutes.

A further mode of realization could be consist in a design in which a nozzle is directly or via a flexible tube integrated into the vehicle's roof structure. The required cooling air could be supplied by the air conditioning system that is probably already present in the vehicle.

Tests have been performed with persons that neither have been under the influence of alcohol, drugs or medication nor have health problems or a pronounced lack of sleep. Thereby, it has shown that the desired effect of keeping awake takes place even after a short period of operation of the apparatus of the invention. However, if the cooling assembly has to be switched on for a relative long period, e.g. more than five minutes, without the signs of sleepiness having disappeared, it must be assumed that the relating person already suffers from a heavy overtiredness. In order to call the attention of the relating person to this fact, it is suggested to provide a warning device in the apparatus that triggers an alarm signal as soon as a predetermined period of operation of the cooling assembly has been exceeded. For this purpose, a shrill alarm tone would be suitable.

Figure 6:
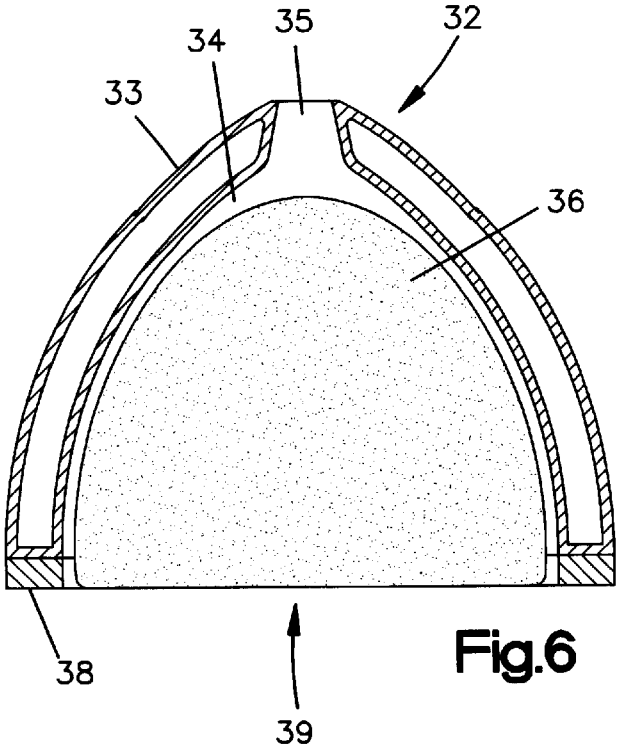
FIG. 6 shows a longitudinal sectional view of a third embodiment of the apparatus.

FIG. 6 shows a longitudinal sectional view of a third embodiment of the apparatus; it should be noted that this illustration is not drawn to scale. The apparatus comprises a capsule member 32 that is provided with a double-wall housing 33 delimiting a hollow space 34 in its interior. The housing 33 is open at its front side 39. The back side of the housing 33 is provided with a central opening 35. In the hollow space 34, there is received a gas permeable material 36, preferably a spongy and/or porous material, for example in the form of cotton wool or wadding. The material 36 is soaked with a volatile agent that vaporizes or sublimates after having been released, whereby heat is withdrawn from the ambient. Finally, the housing 33 is provided with an elastic, circular adhesive tape strip 38 that is located at the front side of the housing 33. The entire capsule 32 is received in a hermetically sealed package for storage, whereby that package is not shown in the drawing in favor of a clearly laid out illustration.

The mode of operation of this capsule 32 can be explained as follows:

After the capsule 32 having been removed from its package, it is pressed onto the forehead of the related person where it remains adhered under the influence of the adhesive strip 38. Thereby, the absorbent material 36 comes into contact with the forehead. Via the opening 35, the volatile agent can evaporate and sublimate, respectively, whereby heat is withdrawn from the ambient. Since the capsule 32 rests and sticks, respectively, relatively tightly on the forehead of the person, and since the capsule 32 is provided with a double-wall insulating housing 33, heat is withdrawn from the forehead of the related person. As volatile agents, for example vaporizing fluids can be taken into account, for example ether, chloroform, esters or lower alcohols, as well as sublimating solids like naphthalene or camphor. In the case of a solid medium, the use of a spongy and/or porous base material 36 can be dispensed with, if appropriate. The size of the contact area amounts to between 0.25 $cm^2$ and 5 $cm^2$ also in this embodiment.

Figure 7:
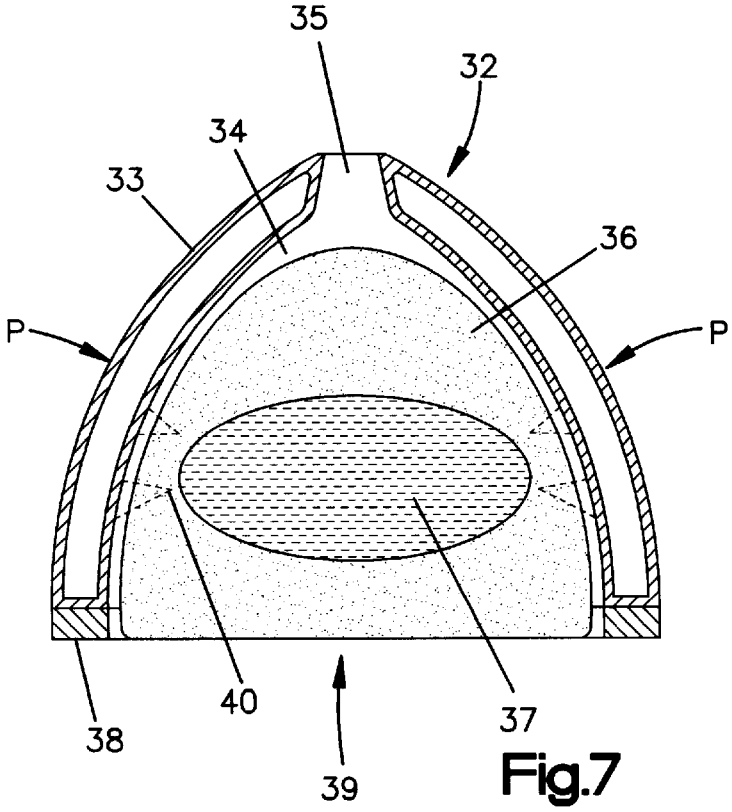
FIG. 7 shows a longitudinal sectional view of a fourth embodiment of the apparatus.

FIG. 7 shows an alternative embodiment of a capsule member 32. In its hollow space 34, there is received a container 37 that is enclosed by the spongy and/or porous base material 36. The container 37 serves for storing the volatile medium and can be broken by an outer mechanical influence. Thus, its content flows into the spongy and/or porous base material 36. Preferably, the housing 33 of the capsule member 32 is designed to be elastically deformable, such that the capsule member 32 can be deformed under the influence of a pressure exerted in the direction of the arrow P to such an extent that the container breaks open. Moreover, the inner side of the capsule member 32 can be provided with break-open elements in the form of spikes 40 whose tips penetrate the container 37 upon exerting a mechanical pressure onto the capsule member 32, such that the content of the container is, if appropriate, in a dosed manner, released.

For breaking open the container 37, thus, only a certain pressure has to be exerted onto the housing 33 of the capsule member 32. In this case, it is not mandatory to provide a packaging wrapping the capsule member 32, but it may suffice to glue the capsule member 32 onto a carrier member. Certainly, a package could be provided that encloses the capsule member and that is designed such that the pressure required to release the capsule member from the package is sufficient to simultaneously break open the container 37.

It is understood that other designs of such capsule members could be possible within the scope of the appended claims that differ from the examples described herein before. For example, the capsule member also could be provided, if required, with radial openings through which the heath could be released more efficiently.

A simple realization could be seen in a design in which a plaster is provided that is filled with a cooling substance. Such a plaster could be applied directly to the forehead by the related person, if required. Finally, the method of the invention could be realized also with an aerosol container by means of which a local place on the head could be specifically cooled.

What is claimed is:

1. A method for preventing a person from falling asleep, particularly a person that drives a vehicle or guides a locomotive or an airplane, characterized in that a specific location on the head of the person is cooled temperature between −10° C. and 10° C., said specific location on the head of the person having an area between 0.25 $cm^2$ and 5 $cm^2$.

2. Method according to claim 1, characterized in that the cooling is accomplished by vaporization or by sublimation of a medium, under withdrawal of the ambient heat.

3. Method according to claim 1, characterized in that the cooling is accomplished by means of a moving gas, by gluing on a cooling device (32) or by putting on a plate member (10) that is in thermal contact with a cooling assembly (6).

4. Method according to claim 3, characterized in that the temperature of the moving gas or of the plate member (10) amounts to between −10° C. and +10° C.

5. Method according to claim 1, characterized in that a signal or an alarm is triggered after a cooling period that has exceeded a predetermined time interval.

6. Apparatus for performing the method described in claim 1, characterized in that a cooling assembly is provided that comprises a cooling aggregate (6, 21) or a closed container for receiving a cooling agent.

7. Apparatus according to claim 6, characterized in that a cooling aggregate in the form of a Peltier cell (6, 21) is provided.

8. Apparatus according to claim 6, characterized in that the apparatus comprises a fan (8) that cools the warm side of the Peltier cell (6) by means of ambient air.

9. Apparatus according to claim 7, characterized in that the apparatus comprises a heat exchanger that is operatively connected to the warm side of the Peltier cell (21) by means of a fluid medium.

10. Apparatus according to claim 8, characterized in that a plate member (10) is provided that is in thermal contact with the cold side of the Peltier cell (6), the plate member (10) being provided to be put onto the location of the head of the person that is to be cooled.

11. Apparatus according to claim 6, characterized in that the apparatus comprises an internal fan (23) that leads ambient air along the cooling assembly (21) and that blows that air towards the head of the person by means of an adjustable outlet nozzle (24).

12. Apparatus for performing the method according to claim 2, characterized in that it comprises a capsule member (32) defining a hollow space (34), a volatile medium being received in that hollow space (34).

13. Apparatus according to claim 12, characterized in that a porous and/or absorbent material (36) adapted to receive the volatile medium is located in the hollow space (34) of the capsule member (32).

14. Apparatus according to claim 12, characterized in that a container (37) for storing the volatile medium is received in the hollow space of the capsule member (32), said container (37) being adapted to be broken open by means of external mechanical influences.

15. Apparatus according to claim 12, characterized in that the housing (33) of the capsule member (32) is elastically deformable.

16. Apparatus according to claim 14, characterized in that the inner side of the capsule member (32) is provided with elements (40) for breaking open the container (37).

17. Apparatus according to claim 12, characterized in that the housing of the capsule member (32) is designed to be thermally insulating and provided with at least one opening (35) for releasing heat from the interior (34) of the capsule member (32).

18. Method according to claim 1, characterized in that the cooling is accomplished by means of a Peltier cell or a refrigerator.

* * * * *

UNITED STATES PATENT AND TRADEMARK OFFICE

CERTIFICATE OF CORRECTION

PATENT NO. : 6,297,728 B1
DATED : October 2, 2001
INVENTOR(S) : Gert Rippbauer

It is certified that error appears in the above-identified patent and that said Letters Patent is hereby corrected as shown below:

Column 5,
Line 27, after "cooled" insert -- to a --.

Signed and Sealed this

Eleventh Day of June, 2002

*Attest:*

*Attesting Officer*

JAMES E. ROGAN
*Director of the United States Patent and Trademark Office*